US006634039B1

(12) United States Patent
Cheng

(10) Patent No.: US 6,634,039 B1
(45) Date of Patent: Oct. 21, 2003

(54) FOLDING STRUCTURE OF A BABY BED

(75) Inventor: Ying-Hsiung Cheng, Tainan Hsien (TW)

(73) Assignee: Pao-Hsien Cheng, Tainan Hsien (TW)

( * ) Notice: Subject to any disclaimer, the term of this patent is extended or adjusted under 35 U.S.C. 154(b) by 0 days.

(21) Appl. No.: 10/288,501

(22) Filed: Nov. 6, 2002

(51) Int. Cl.[7] ..... A47C 7/00
(52) U.S. Cl. ..... 5/99.1
(58) Field of Search ..... 5/99.1, 98.1, 93.1, 5/102; 403/102, 100, 325

(56) References Cited

U.S. PATENT DOCUMENTS 5,611,634 A * 3/1997 Wang ..... 403/102
6,148,456 A * 11/2000 Tharalson et al. ..... 5/99.1
6,202,229 B1 * 3/2001 Cheng ..... 5/99.1

* cited by examiner

*Primary Examiner*—Teri Pham Luu
(74) *Attorney, Agent, or Firm*—Rosenberg, Klein & Lee

(57) ABSTRACT

A folding structure of a baby bed includes a joining member, and an elongated co-moving plate. The baby bed has a base including first and second supporting rods; the supporting rods being pivoted to respective end portions of the joining member. The joining member is formed with a curved slot thereon. The elongated co-moving plate is pivotally connected to the supporting rods at two end so that part of force exerted on one of the supporting rods for same to pivot on the joining member is imparted to the other supporting rod. A pin is passed through the curved slot as well as one of the supporting rods so that movement of the supporting rods is restricted in folding operation of the baby bed.

1 Claim, 4 Drawing Sheets

FOLDING STRUCTURE OF A BABY BED

BACKGROUND OF THE INVENTION

1. Field of the Invention

The present invention relates to a folding structure of a baby bed, more particularly a folding structure of a baby bed, which allows a baby bed to be folded smoothly and with relatively little labor.

2. Brief Description of the Prior Art

The applicant of the present invention disclosed a joint of a foldable baby bed as shown in FIG. 4 in a patent application on U.S. Patent Office, and has been granted with U.S. Pat. No. 6,202,229 with this invention.

The joint of a foldable baby bed has a main body 1, a pressing block 2 and two supporting members 3.

The main body 1 has two side plates 11, 12 and a curved intermediate portion 13 formed between the side plates 11, 12. The intermediate portion 13 has two stopping plates 132 extending downwards. The pressing block 2 has an elongated hole 21, two engaging trenches 22 and a round hole 23. A spring 24 is mounted on the round hole 23 at a lower end thereof.

Each of the supporting members 3 has an engaging protrusion 32, an elastic plate 33, and a curved portion 34.

In combination, the pressing block 2 is up and down movably hidden in the main body 1. The spring 24 is positioned such as to bias the pressing block 2 downwards. Each of the supporting members 3 is pivotally connected to the side plates 1, 2 beside a respective side of the pressing block 2. Each of the engaging protrusions 32 of the supporting members 3 can disengagably engage a respective one of the engaging trenches 22 of the pressing block 2 to locate the supporting members 3 at a locking position. And, the elastic plates 33 of the supporting members 3 will be located between the stopping plates 132 of the main body 1.

Two supporting rods 4 of the frame of the foldable bed are pivoted to the main body 1 so that inner ends of the supporting rods 4 will be stopped from moving down by the curved portions 34 of the supporting members 3 when the baby bed is stretched and the supporting members 3 are located at the locking position.

To fold the bed, first the main body 1 has to be lifted upwards so that the inner ends of the supporting rods 4 can move away from the curved portions 34 of the supporting members 3. Thus, the engaging protrusions 32 can be disengaged from the pressing block 2 by means of propping up the pressing block 2. And, the supporting rods 4 can be pivoted on the main body 1 for folding the baby bed.

To stretch the baby bed from the folded position, the supporting rods 4 are pivoted on the main body 1 so that the inner ends thereof can be supported on the curved portions 34 of the supporting members 3.

The folding structure has an advantage that when the baby bed is in the stretched position, the inner ends of the supporting rods 4 will press the curved portions 34 of the supporting members 3 due to gravity so that the engaging protrusions 32 will engage the engaging trenches 22 firmly; thus, the supporting members 3 cannot be unlocked, and the baby bed cannot be folded in case the pressing block 2 is pressed accidentally.

However, because there is no co-moving mechanism provided to the supporting rods 4, the users have to pivot both the supporting rods on the joining member 1 with their hands. Therefore, the folding operation and the stretching operation are not very smooth, and cost relatively much labor. In addition, the user's fingers are likely to be clipped between the supporting rods 4 and two ends of the intermediate portion 13, and get hurt when the baby bed is being folded because the movement of the supporting rods 4 is not restricted. To overcome this disadvantage, pads are attached to the intermediate portion 13 to prevent the user's fingers from getting hurt in folding the baby bed. However, the effect is not very satisfactory.

SUMMARY OF INVENTION

It is a main object of the present invention to provide a folding structure to a baby bed so that the baby bed can be folded and stretched smoothly and with relatively little labor.

It is another object of the present invention to provide a clip prevention mechanism to the folding structure of a baby bed so that the user's fingers can't be clipped between the components of the folding structure to get hurt when the baby bed is being folded.

The folding structure of a baby bed of the present invention includes a joining member, a locking mechanism, and an elongated co-moving plate. The joining member has spaced-apart opposing first and second plate portions, and an intermediate portion formed on tops of the plate portions thereof. The locking mechanism is movably supported in a middle of the joining member between the opposing plate portions. The baby bed has a base including a first and a second supporting rods, which are pivoted to respective end portions of the joining member at first pivotal holes of inner sections thereof to be unlockably engaged with the locking mechanism at inner ends thereof. The first plate portion of the joining member is formed with a curved slot thereon. The elongated co-moving plate is pivotally connected to a second pivotal hole of the inner section of the first supporting rod with a first pivotal pin, which is passed through the curved slot, at a first end thereof. The elongated co-moving plate is pivotally connected to a second pivotal hole of the second supporting rod at a second end thereof. Thus, part of force exerted on one of the supporting rods for same to pivot on the joining member is imparted to other one of the supporting rods, and movement of the supporting rods is restricted by both the first pivotal pin and the curved slot in folding operation of the baby bed.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
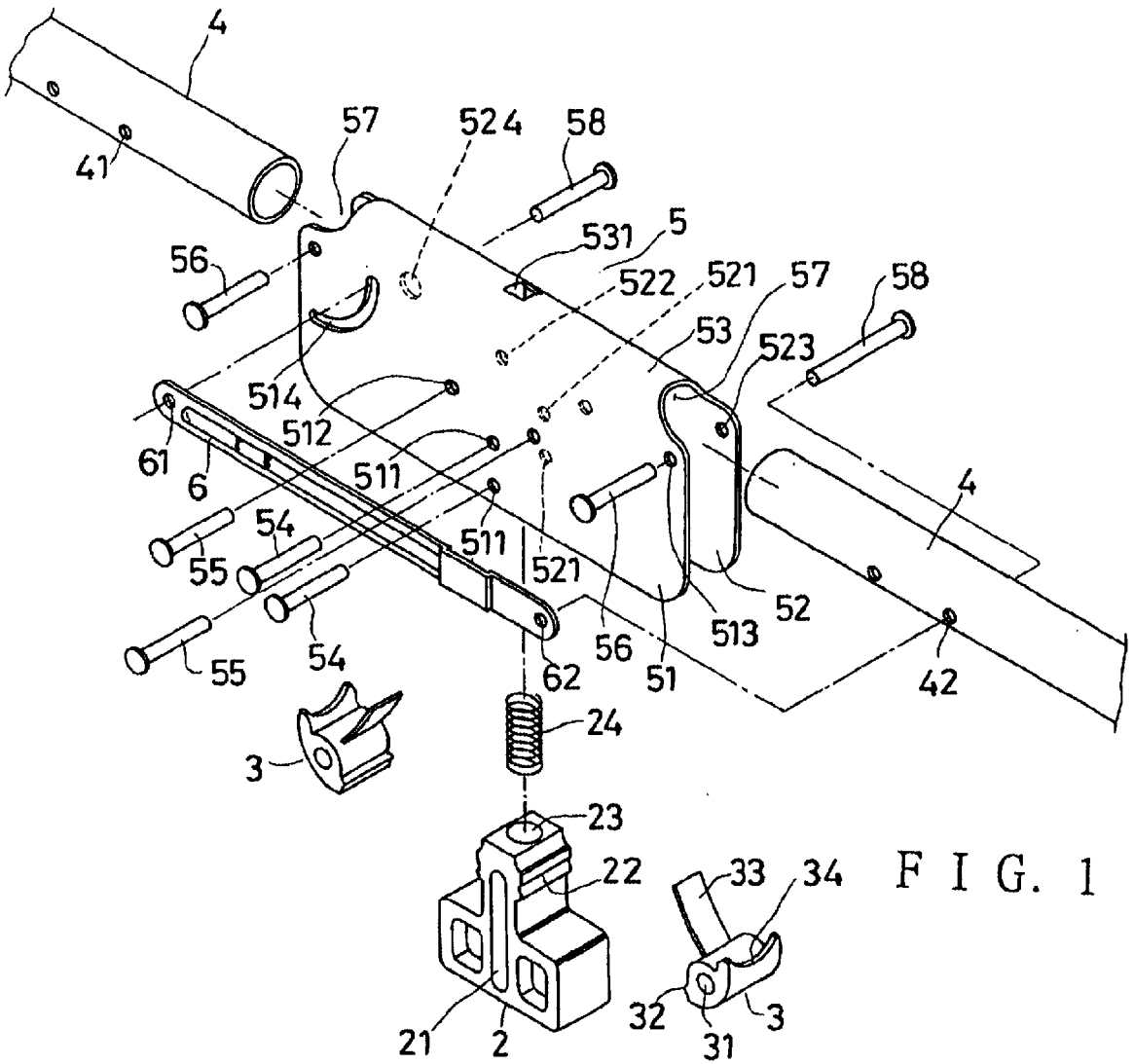
FIG. 1 is an exploded perspective view of the improvement on a folding structure of a baby bed according to the present invention.
Figure 2:
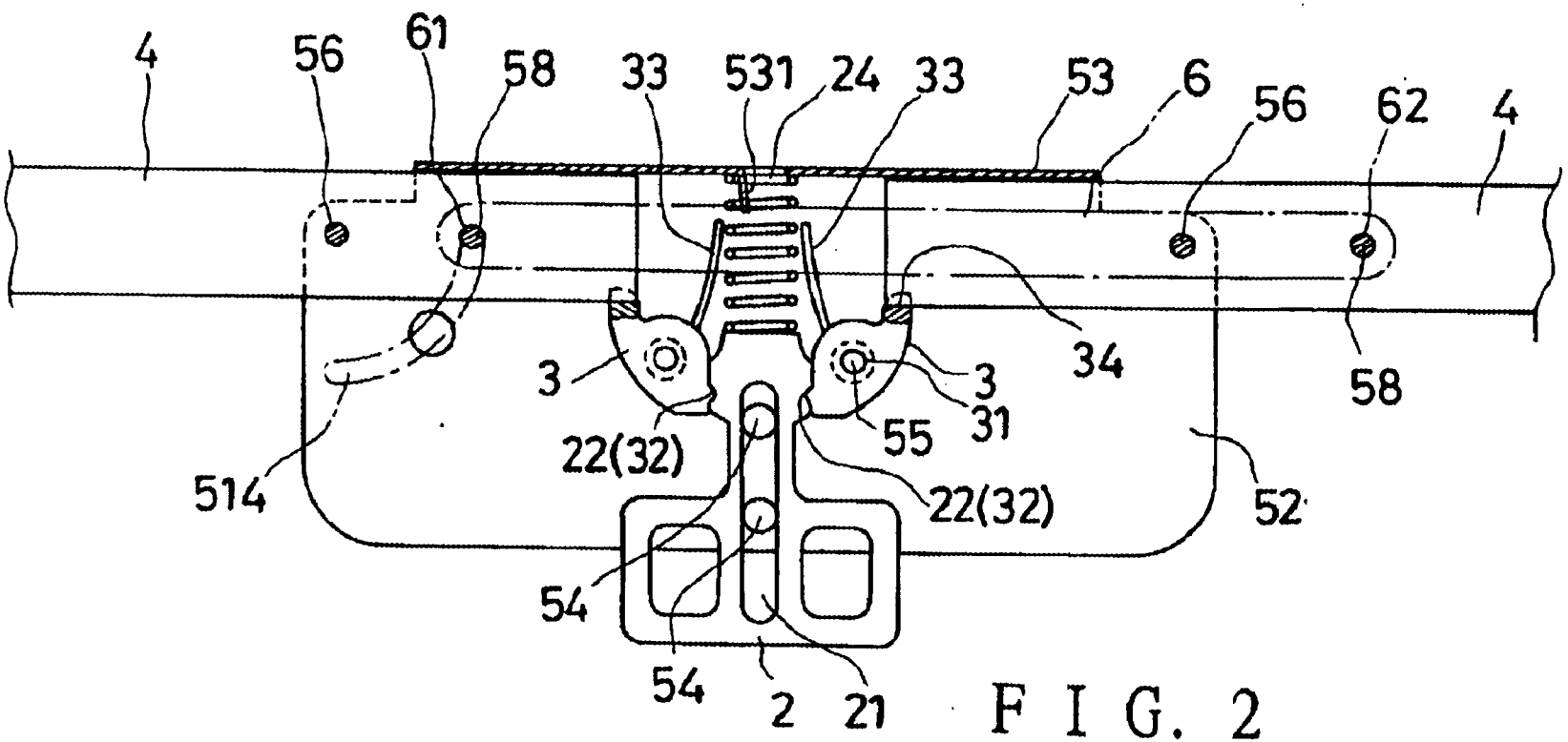
FIG. 2 is a plan of the improvement on a folding structure of a baby bed according to the present invention.
Figure 3:
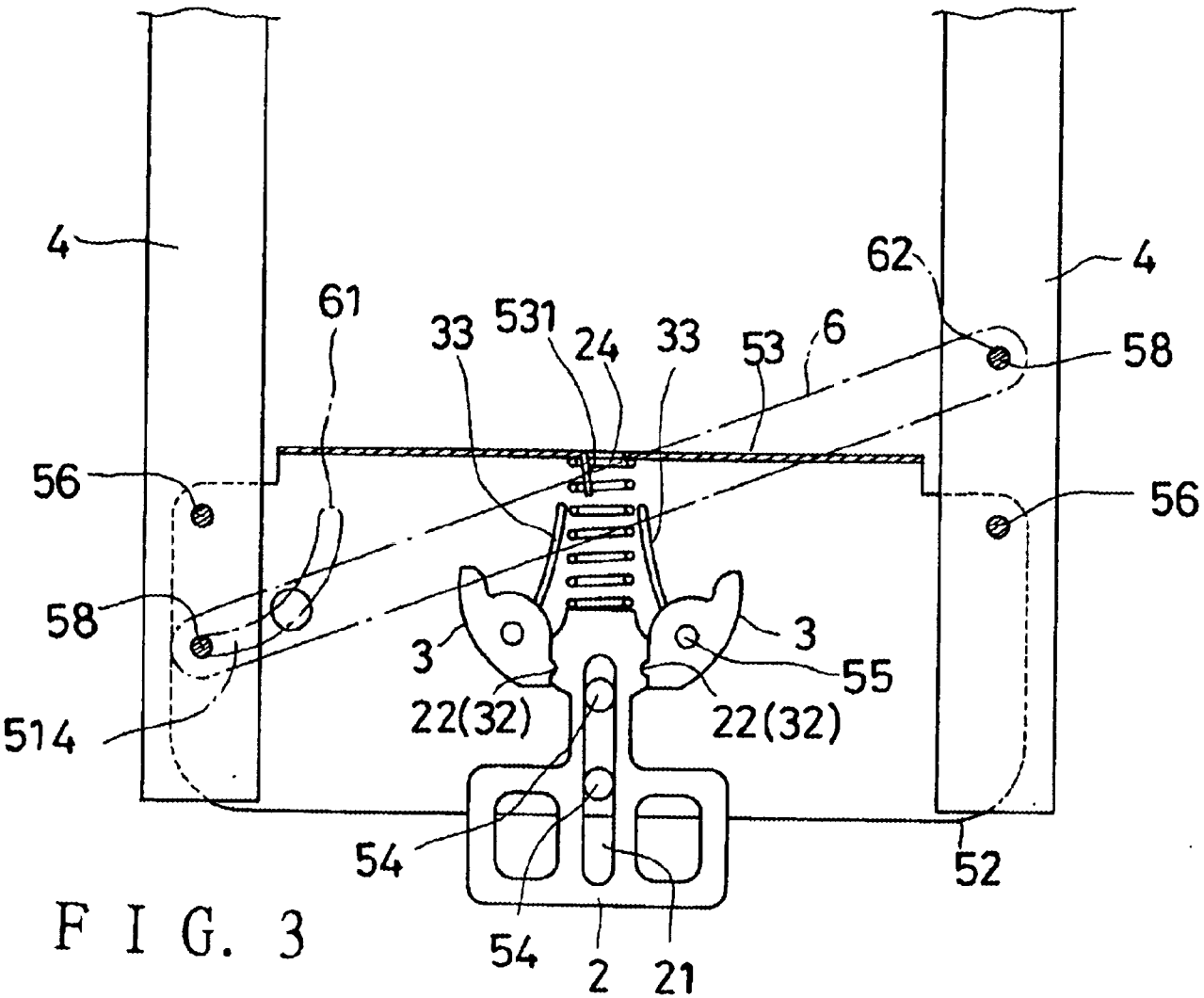
FIG. 3 is a view illustrating the function of the improvement on a folding structure of a baby bed according to the present invention; and, FIG. 4 is an exploded perspective view of the conventional folding structure of a baby bed as described in the Background.
Figure 4:
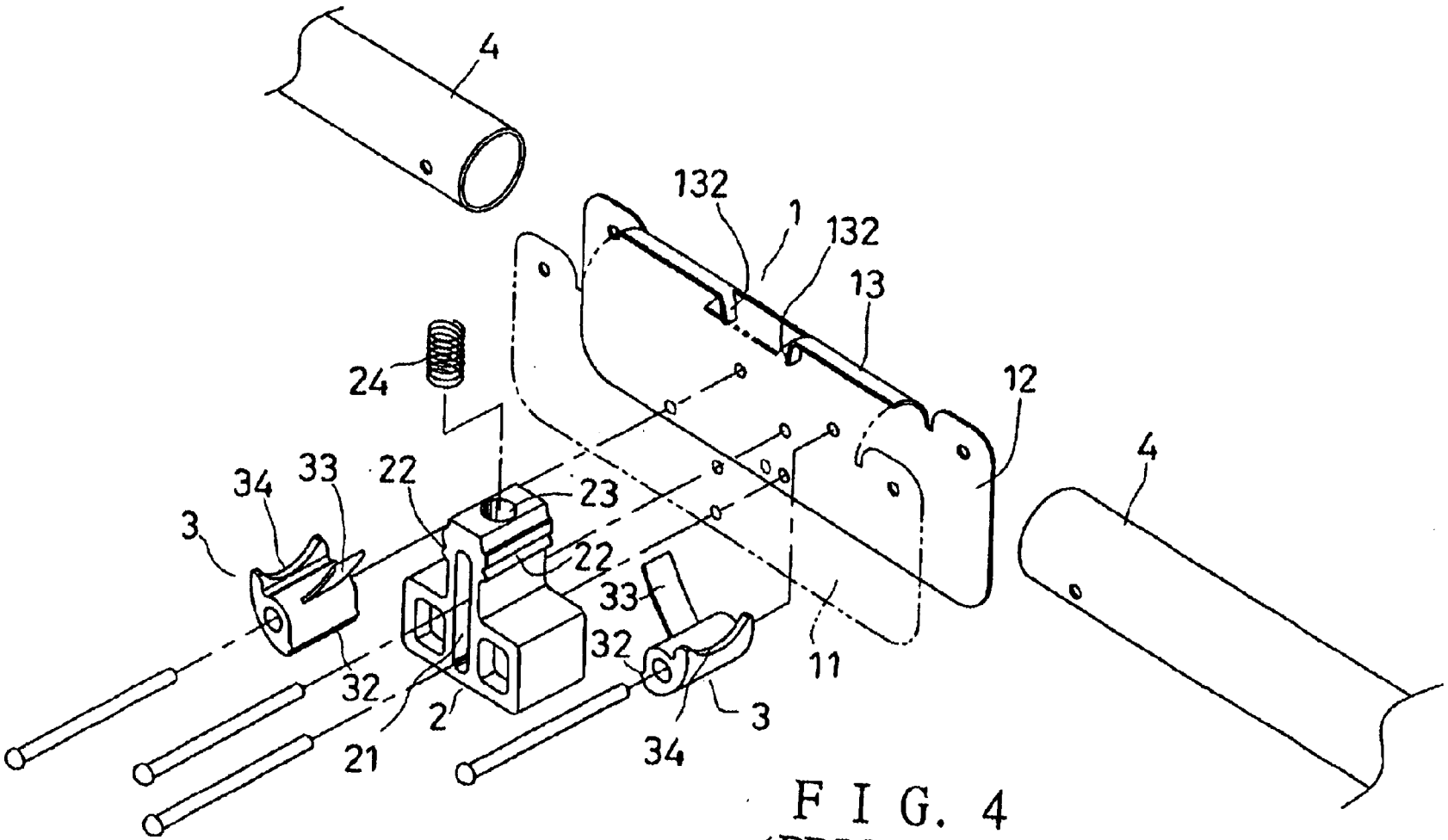
FIG. 4 (PRIOR ART)

Referring to FIGS. 1, 2, and 3, a folding structure of a baby bed according to the present invention includes a joining member 5, an elongated co-moving plate 6, and a locking mechanism, which includes a first locking member 2, and a pair of second locking members 3, 3.

The joining member 5 has spaced-apart opposing first and second plate portions 51, 52, and an intermediate portion 53 formed on tops of the plate portions 51, 52 thereof. The intermediate portion 53 is shorter than the plate portions 51, 52 so that gaps 57 are formed at two ends of the joining member 5.

The plate portion 51 has two locating holes 511 and two connecting holes 512, and the plate portion 52 has two locating holes 521, and two connecting holes 522, which are aligned with corresponding locating holes 511, and corresponding connecting holes 512. The connecting holes 512 are arranged higher than the upper one of the locating holes 511. The intermediate portion 53 has a stopping plate 531 extending downwards. The plate portions 51, 52 have aligned pivotal holes 513, 523 near the gaps 57. Furthermore, the plate portion 51 has a curved slot 514 thereon.

The first locking member 2 has an elongated hole 21, two engaging trenches 22 and a round hole 23. A spring 24 is mounted on the round hole 23 at a lower end thereof.

The second locking members 3 each has a through hole 31, an engaging protrusion 32, an elastic plate 33 and a curved portion 34.

The elongated co-moving plate 6 has pivotal holes 61, and 62 on two ends thereof.

First and second supporting rods 4, 4 of a base of a baby bed is pivoted to the joining member 5 with pivotal pins 56 being passed through first pivotal holes (not numbered) thereof as well as the pivotal holes 513, 523. The first supporting rod 4 has second pivotal holes 41, which are located between the inner end of the first supporting rod 4 and the first pivotal hole of the first supporting rod 4. The second supporting rod 4 has second pivotal holes 42, which are located farther away from the inner end of the second supporting rod than the first pivotal hole of the second supporting rod 4.

In combination, the first locking member 2 is movably received within the joining member 5 with two locating rivets 54, 54 passed through the elongated hole 21 thereof as well as the locating holes 511, 521 of the joining member 5. The spring 24 is positioned between the stopping plate 531 under the intermediate portion 53 and the first locking member 2, such that the first locking member 2 is biased by the same.

The second locking members 3 are each pivoted to the connecting holes 512, 522 of the joining member 5 with connecting pins 55 being passed through the through holes 31 of the second locking members 3 as well as the connecting holes 512, 522. The engaging protrusions 32 of the second locking members 3 will disengagably engage respective ones of the engaging trenches 22 of the first locking member 2 to locate the second locking members 3 at a first position. The curved portions 34 of the second locking members 3 will be located at the first position to engage the inner ends of respective supporting rods 4 when the baby bed is stretched to an in-use position.

Furthermore, the elongated co-moving plate 6 is pivotally connected to the second pivotal hole 41 of the first supporting rod 4 at the pivotal hole 61 thereof with a pivotal pin 58, which is also passed through the curved slot 514. And, the elongated co-moving plate 6 is pivotally connected to the second pivotal hole 42 of the second supporting rod 4 at the pivotal hole 62 thereof by means of another pivotal pin 58.

When the engaging protrusions 32 are disengaged form the engaging trenches 22 of the first locking member 2 to be in the unlocked position, the supporting rods 4, 4 are free to pivot on the joining member 5, allowing the users to fold and stretch the baby bed. Because of the elongated co-moving plate 6, part of force exerted on one of the supporting rods 4, 4 is imparted to the other one in both the folding operation and the stretching operation of the baby bed base. Thus, the supporting rods 4, 4 can be pivoted on the joining member 5 more easily and smoothly when the baby bed is being folded of stretched.

When the baby bed is stretched, and when the first locking member 2 is released, the second locking members 3, 3 will be engaged with the first locking member 2 again to prevent the inner ends of the supporting rods 4 from moving down.

From the above description, it can be understood that the folding structure of a baby bed of the present invention has desirable features as following:

1. The baby bed can be folded and stretched more easily because of the elongated co-moving plate 6, therefore relatively much labor is saved.
2. Because the pivotal pin 58, to which the elongated co-moving plate 6 is pivotally connected, is also passed through the curved slot 514, movement of the pivotal pin 18 is guided, and the baby bed can be folded and stretched relatively smoothly as compared with the conventional one.
3. When folding operation of the baby bed is finished, the elongated co-moving plate 6 and the curved slot 514 work together to stop the supporting rods 4, 4 from moving further towards the ends of the intermediate portion 53 of the joining member 5 should there be still space between the supporting rods 4 and the intermediate portion 53; thus, the user's fingers won't be clipped between the supporting rods 4 and the intermediate portion 53 to get hurt.

What is claimed is:

1. A folding structure of a baby bed, comprising:

a joining member having spaced-apart opposing first and second plate portions, and an intermediate portion formed on respective top portions of the plate portions;

a locking mechanism disposed in a middle of the joining member between the opposing plate portions; and, an elongated co-moving plate;

the baby bed having a base including first and second supporting rods, the supporting rods being pivoted to respective end portions of the joining member at first pivotal holes of inner sections thereof to be releasably lockingly engaged with the locking mechanism at inner ends thereof;

the first plate portion of the joining member being formed with a curved slot therein, the curved slot being nearer to the first supporting rod than the second supporting rod;

the elongated co-moving plate being pivotally connected to a second pivotal hole formed on the inner section of the first supporting rod with a first pivotal pin at a first end thereof; the first pivotal pin being passed through the curved slot, the elongated co-moving plate being pivotally connected to a second pivotal hole of the second supporting rod at a second end thereof;

the second pivotal hole of the first supporting rod being located between the inner end of the first supporting rod and the first pivotal hole of the first supporting rod, the second pivotal hole of the second supporting rod being located farther away from the inner end of the second supporting rod than the first pivotal hole of the second supporting rod;

a portion of a force exerted on one of the supporting rods for the supporting rod to pivot on the joining member being imparted to the other supporting rod via the elongated co-moving plate, helping the other supporting rod move in both a folding operation and a stretching operation of the baby bed.

* * * * *